US007971635B2

(12) United States Patent
Kämmler

(10) Patent No.: US 7,971,635 B2
(45) Date of Patent: Jul. 5, 2011

(54) COLLECTING TANK AND HEAT EXCHANGER

(75) Inventor: George Kämmler, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 1177 days.

(21) Appl. No.: 10/552,722

(22) PCT Filed: Apr. 6, 2005

(86) PCT No.: PCT/EP2004/003681

§ 371 (c)(1),
(2), (4) Date: Apr. 10, 2006

(87) PCT Pub. No.: WO2004/090457

PCT Pub. Date: Oct. 21, 2004

(65) Prior Publication Data

US 2006/0231245 A1 Oct. 19, 2006

(30) Foreign Application Priority Data

Apr. 10, 2003 (DE) ..... 103 16 755

(51) Int. Cl.
*F28F 9/02* (2006.01)
*F28D 1/02* (2006.01)

(52) U.S. Cl. ..... 165/173; 165/67

(58) Field of Classification Search ..... 165/173, 165/174, 176, 906, 67, 175, 153
See application file for complete search history.

(56) References Cited

U.S. PATENT DOCUMENTS

| | | | | | |
|---|---|---|---|---|---|
| 1,847,743 | A | * | 3/1932 | Anderson | 165/76 |
| 2,559,256 | A | * | 7/1951 | Matheny | 285/126.1 |
| 4,678,026 | A | * | 7/1987 | Lenz et al. | 165/67 |
| 4,709,757 | A | * | 12/1987 | Bly | 165/173 |
| 4,739,828 | A | * | 4/1988 | Bayer et al. | 165/173 |
| 4,770,341 | A | | 9/1988 | Drake | |
| 4,923,001 | A | * | 5/1990 | Marcolin | 165/140 |
| 5,063,995 | A | | 11/1991 | Forster | |
| 5,107,924 | A | * | 4/1992 | Herbert et al. | 165/173 |
| 5,351,751 | A | * | 10/1994 | Cage et al. | 165/173 |
| 5,535,821 | A | * | 7/1996 | Potier | 165/173 |
| 5,540,278 | A | * | 7/1996 | Chiba et al. | 165/175 |
| 6,309,774 | B1 | | 10/2001 | Buchner et al. | |
| 6,315,036 | B1 | | 11/2001 | Pogue et al. | |
| 2006/0151157 | A1 | * | 7/2006 | Kammler | 165/173 |

FOREIGN PATENT DOCUMENTS

DE 38 41 470 A1 6/1990

(Continued)

OTHER PUBLICATIONS

Georg Kämmler, U.S.PTO Office Action, U.S. Appl. No. 10/552,721, dated Sep. 15, 2009, 11 pgs.

*Primary Examiner* — Tho v Duong
(74) *Attorney, Agent, or Firm* — Foley & Lardner LLP

(57) ABSTRACT

The invention relates to a plastic charge air tank or coolant tank (5) comprising at least one tie rod (10) that is integrated thereinto and is connected thereto as a single piece or in a fixed manner. The tie rod (10) is provided with at least one continuous hollow space which extends along the longitudinal axis thereof.

26 Claims, 1 Drawing Sheet

FOREIGN PATENT DOCUMENTS

| | | | |
|---|---|---|---|
| DE | 39 09 996 | A1 | 10/1990 |
| DE | 40 41 671 | A1 | 6/1992 |
| DE | 44 42 038 | A1 | 5/1996 |
| DE | 195 47 618 | C1 | 6/1997 |
| DE | 196 49 691 | A1 | 6/1998 |
| DE | 694 09 185 | T2 | 2/1999 |
| DE | 200 03 919 | U1 | 5/2000 |
| DE | 100 41 123 | A1 | 3/2002 |
| EP | 0 280 107 | A1 | 8/1988 |
| EP | 0 641 985 | B1 | 3/1998 |
| EP | 1 116 928 | A2 | 7/2001 |
| EP | 1 273 868 | A2 | 1/2003 |
| FR | 2 614 980 | A1 | 11/1988 |
| FR | 2 742 533 | A1 | 6/1997 |
| GB | 844466 | | 8/1960 |
| GB | 2 082 312 | A | 3/1982 |
| JP | 3-5086 | U | 1/1991 |

* cited by examiner

COLLECTING TANK AND HEAT EXCHANGER

The invention relates to a collecting tank, in particular for a motor vehicle, and also to a heat exchanger.

BACKGROUND

Conventional, injection-molded plastic charge-air tanks, which are subjected to great loads, to be specific high temperatures and high pressures, are often formed in regions with particularly high loads with tie rods, which form a connection from one wall of the charge-air tank to the other. These tie rods are generally allowed for in the form in which the tank is produced and are injection-molded along with the charge-air tank from the same material. However, such a charge-air tank still leaves something to be desired.

Therefore, EP 0 641 985 B1 discloses a heat exchanger tank with a number of reinforcing struts, which are formed separately from the heat exchanger tank and inserted into depressions, which extend between opposite walls of the heat exchanger tank, after the completion of the heat exchanger tank. In this case, however, production is relatively complex, so that such a heat exchanger tank also still leaves something to be desired.

SUMMARY

It is the object of the invention to provide an improved collecting tank and/or heat exchanger.

According to the invention, the tie rod, which is formed in one piece with the charge-air tank or coolant tank, in particular from plastic, or is at least connected to it in a fixed manner, in particular by means of being molded in, comprises a continuous hollow space, preferably open on both sides. This is preferably produced in one operation with the production of the remaining collecting tank, in particular by means of injection-molding. Alternatively, an insert may be provided, which is placed into the mold, in particular before the injection-molding. In principle, it is also possible to push the tie rod into openings made during the injection-molding and subsequently seal it, whereby an integral connection is also possible. In this case, the hollow space serves for temperature control, for example cooling of the tie rod, which under some circumstances is exposed to high temperatures.

With preference, the hollow space is formed continuously in a tensile direction of the tie rod. With particular preference, a coolant is conducted through the hollow space, which coolant may also be ambient air, since the material temperatures can in this way be specifically lowered in the regions that are subjected to the greatest loading. In this way, the oxidative aging of the plastic is slowed, whereby the service life increases. Furthermore, less expensive plastics can also be used or, in certain cases, the use of plastics instead of aluminum becomes possible in the first place. The hollow space is preferably formed by a tube arranged in the tie rod, in particular with a substantially circular or oval cross section. In this case, it is also possible for a number of thin tubes to be arranged next to one another, formed separately or in one piece.

Furthermore, inserts are possible in the tie rod, for example metal insert parts, metal strips, insert parts of fibrous material, tapes of fibrous material and/or fibers, the fibrous materials or the fibers being glass or carbon fibers in particular. These inserts serve both for reinforcing the tie rod (for example glass fibers) and for additional heat dissipation (for example copper wires or foils). An encapsulation with a plastic is preferably provided. This applies in particular to the variant in which the tie rod is pushed in and sealed after the injection-molding. The plastic encapsulation, which consists in particular of a plastics material that allows itself to bond without any problem with the plastics material of the charge-air tank or coolant tank, makes a very good, preferably integral, connection of the plastics materials possible.

According to a preferred refinement, a collecting tank according to the invention is used in a heat exchanger, heat exchange tubes opening out into the collecting tank. In particular, the heat exchanger has corrugated ribs to increase the size of a heat-exchanging surface, the corrugated ribs being soldered for example to the heat exchange tubes. Such heat exchangers can be used in particular in motor vehicles.

Moreover, there is the possibility of using the collecting tank according to the invention in any desired heat exchanger on its own or in conjunction with at least one further collecting tank, it being possible for the at least one further collecting tank to be likewise a collecting tank according to the invention or a collecting tank according to the prior art.

The invention is explained in detail below on the basis of three exemplary embodiments.

A collecting tank according to the invention, formed as a coolant tank of an air-conditioning system of a motor vehicle, consists of polyamide reinforced with glass fibers, with tie rods, which comprise an insert of a glass fiber tape. For the production of the coolant tank, a chemical, exothermally or endothermally acting blowing agent in granular form is added to a polyamide in granular form, mixed with glass fibers to accelerate the crystallization, the blowing agent being encapsulated with polyethylene, and the granules are mixed with one another and fed to an injection-molding machine.

In a screw of the injection-molding machine, a plastication of the granules takes place in a known way to form a polymer melt as a result of heat (240-290° C.) and pressure. This plastic polymer melt is filled into an injection mold, into which reinforcing elements, in the present case glass fibers arranged in the manner of tubes, which are encapsulated with polyamide, are automatically placed at the locations at which tie rods are intended. In this case, the reinforcing element is formed so stably that the hollow space inside is not destroyed during the injection-molding. On account of high temperatures, the blowing agent reacts by emitting thermal energy with the formation of $CO_2$. The blowing agent or the $CO_2$ produced brings about faster filling of the injection mold, since a slight shrinkage in the volume of the polymer melt occurs during cooling, so that no plasticated polymer melt, or only a minimal amount, has to be pushed in afterwards to compensate for the shrinkage in volume. The injected polyamide integrally bonds with the polyamide of the glass fiber encapsulation, so as to form tie rods that are integrated in one piece in the coolant tank and reinforced with glass fibers to meet the requirements.

The polymer melt remains in the injection mold until the mold is filled and a certain crystallization and relaxation have taken place. Subsequently, the injection mold is opened, the coolant tank is removed and a clamping frame is immediately inserted to prevent sinking of the coolant tank. According to the method as provided by the invention, the coolant tank has a surface temperature of about 120° C. when it is removed. In this case, the clamping frame may be cooled.

For further processing, a rubber cord seal is placed around an aluminum tank base, the clamping frame is removed from the coolant tank, the coolant tank is placed as quickly as possible, i.e. within about 30-60 seconds, onto the aluminum tank base with the rubber cord seal and pressed in a press.

According to a second exemplary embodiment, thin metal tubes, which are intended for reinforcing and cooling the tie rods, are placed into the injection mold and molded in for a charge-air tank, the ends of the metal tubes protruding from the mold, so that connection to a coolant circuit is possible later. The coolant cooler is generally arranged near the charge-air tank and therefore only minor changes are required for a charge-air tank that is cooled in a certain region, that is to say in the region of the tie rods.

According to a third exemplary embodiment, the tie rod is molded together with the continuous hollow space directly in one operation, without inserts being provided.

BRIEF DESCRIPTION OF THE DRAWINGS

Exemplary embodiments of the invention are described in more detail on the basis of a drawing, in which.

DETAILED DESCRIPTION

Figure 1:
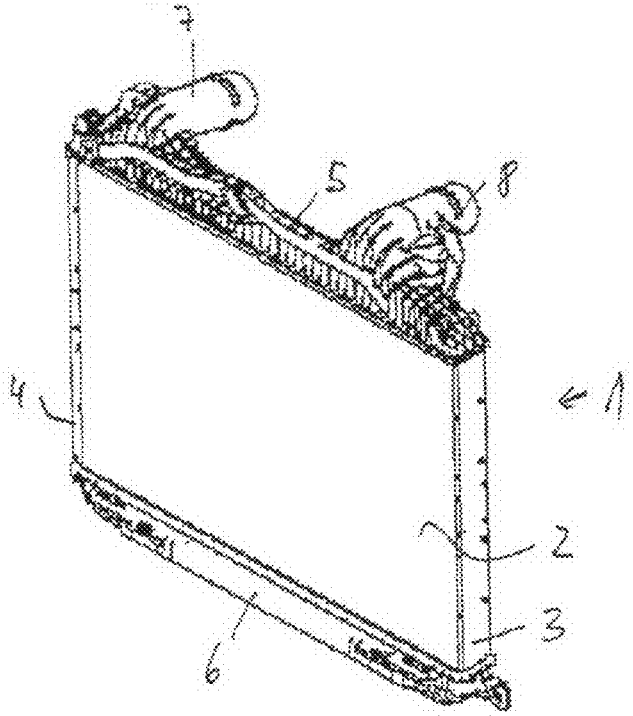
FIG. 1 shows a perspective representation of a heat exchanger.

FIG. 1 shows a heat exchanger 1, such as a charge-air cooler with a tube-rib block 2, in which the individual tubes (not represented) are connected, such as for example soldered, to corrugated ribs arranged in between. Arranged to the sides of the tube-rib block 2 are side parts 3, 4. The tubes of the tube-rib block 2 are fluidically connected to collecting tanks 5, 6, so that the fluid, such as charge air, flowing into the one collecting tank 5 via the connecting piece 7 flows through part of the tubes of the tube-rib block to the second collecting tank 6, and from there via a further part of the tubes back to the first collecting tank, and from there can flow out through the connecting piece.

Figure 2:
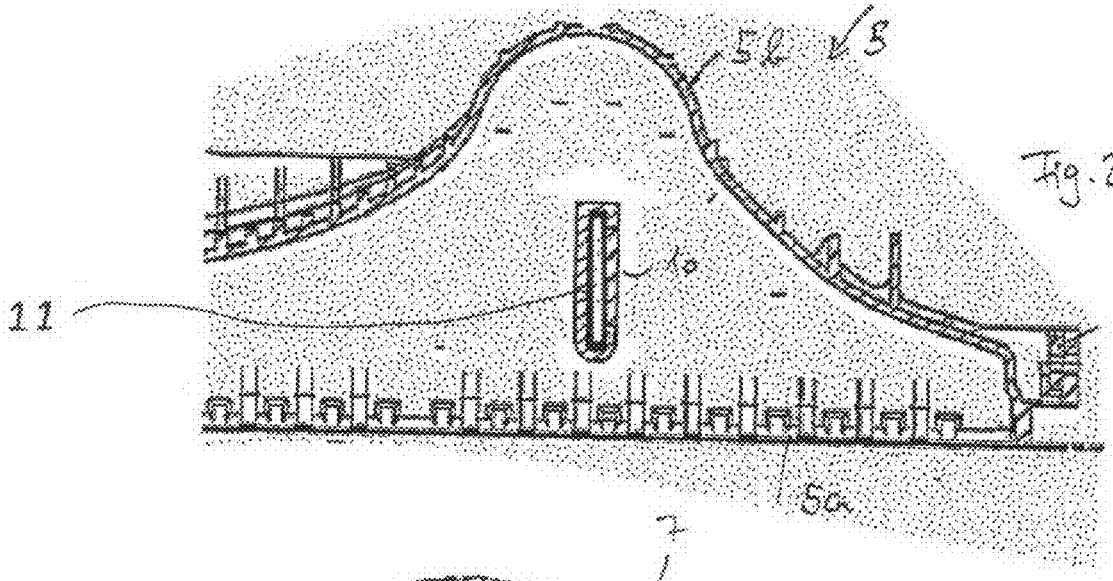
FIG. 2 shows a partial section through a collecting tank.

FIG. 2 shows a section through a collecting tank 5 with a tube sheet 5*a* and a cover 5*b*. Arranged in the region of the bell-shaped contour is a connecting piece 7, 8, which however is not visible in this representation. Arranged between a front wall of the cover of the collecting tank and a rear wall of the cover of the collecting tank is a tie rod 10. This tie rod is formed in a hollow manner. An insert 11 is possible in the tie rod, for example metal insert parts, metal strips, insert parts of fibrous material, tapes of fibrous material and/or fibers, the fibrous materials or the fibers being glass or carbon fibers in particular. Such inserts serve both for reinforcing the tie rod (for example glass fibers) and for additional heat dissipation (for example copper wires or foils). An encapsulation with a plastic is preferably provided. This applies in particular to the variant in which the tie rod is pushed in and sealed after the injection-molding. The plastic encapsulation, which consists in particular of a plastics material that allows itself to bond without any problem with the plastics material of the charge-air tank or coolant tank, makes a very good, preferably integral, connection of the plastics materials possible. In another example, an insert may be placed into a mold, in particular before injection-molding.

Figure 3:
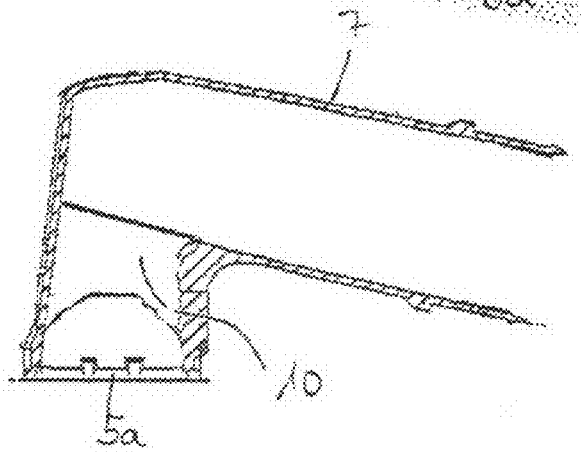
FIG. 3 shows a section through a collecting tank.

FIG. 3 shows a collecting tank in the region of the connecting piece 7 in section. In this case, the tube sheet 5*a* and the tie rod 10 can be seen.

The invention claimed is:

1. A collecting tank made of plastic for a heat exchanger that includes a tube block with a plurality of tubes, comprising:

at least one tie rod, which is integrated into the collecting tank, formed in one piece with the collecting tank or connected to the collecting tank in a fixed manner, wherein the tie rod has at least one hollow space, formed continuously in a tensile direction of the tie rod, wherein the tie rod extends from a front side and a rear side of the collecting tank, wherein the front side and the rear side are opposite to one another, wherein the collecting tank is configured to be connected to the tube block of the heat exchanger such that the tie rod is spaced apart from the tubes of the tube block and the tie rod is not connected to the tubes of the tube block, wherein the collecting tank is configured such that a direction of flow through the hollow space of the tie rod extends orthogonally to a direction of flow through the tubes of the tube block.

2. The collecting tank as claimed in claim 1, wherein the hollow space is open on one side of the tie rod.

3. The collecting tank as claimed in claim 1, wherein at least one insert, which defines the hollow space, is provided in the tie rod.

4. The collecting tank as claimed in claim 3, wherein the at least one insert is a tube.

5. The collecting tank as claimed in claim 3, wherein an encapsulation of the insert with a plastic is provided.

6. The collecting tank as claimed in claim 1, wherein the hollow space is formed such that a fluid can flow through the hollow space.

7. The collecting tank as claimed in claim 6, wherein connections for a fluid supply and a fluid discharge are provided on one or both sides of the hollow space.

8. A heat exchanger for a motor vehicle, comprising heat exchange tubes which open out into at least one collecting tank, wherein the at least one collecting tank is the collecting tank of in claim 1.

9. The collecting tank as claimed in claim 2, wherein at least one insert, which defines the hollow space, is provided in the tie rod.

10. The collecting tank as claimed in claim 4, wherein an encapsulation of the insert with a plastic is provided.

11. The collecting tank as claimed in claim 2, wherein the hollow space is formed such that a fluid can flow through the hollow space.

12. The collecting tank as claimed in claim 3, wherein the hollow space is formed such that a fluid can flow through the hollow space.

13. The collecting tank as claimed in claim 4, wherein the hollow space is formed such that a fluid can flow through the hollow space.

14. The collecting tank as claimed in claim 5, wherein the hollow space is formed such that a fluid can flow through the hollow space.

15. A heat exchanger for a motor vehicle, comprising heat exchange tubes which open out into at least one collecting tank, wherein the at least one collecting tank is the collecting tank of claim 2.

16. A heat exchanger for a motor vehicle, comprising heat exchange tubes which open out into at least one collecting tank, wherein the at least one collecting tank is the collecting tank of claim 3.

17. A heat exchanger for a motor vehicle, comprising heat exchange tubes which open out into at least one collecting tank, wherein the at least one collecting tank is the collecting tank of claim 4.

18. A heat exchanger for a motor vehicle, comprising heat exchange tubes which open out into at least one collecting tank, wherein the at least one collecting tank is the collecting tank of claim 5.

19. A heat exchanger for a motor vehicle, comprising heat exchange tubes which open out into at least one collecting tank, wherein the at least one collecting tank is the collecting tank of claim 6.

20. A heat exchanger for a motor vehicle, comprising heat exchange tubes which open out into at least one collecting tank, wherein the at least one collecting tank is the collecting tank of claim 7.

21. The collecting tank as claimed in claim 1, wherein the collecting tank is a charge-air tank or a coolant tank.

22. The collecting tank as claimed in claim 2, wherein the hollow space is open on two opposite sides of the tie rod.

23. The collecting tank as claimed in claim 1, wherein the collecting tank is configured to be connected to the tube block of the heat exchanger such that a first heat exchange medium flows through the tubes of the tube block and a second heat exchange medium flows through the at least one tie rod that is different from the first heat exchange medium.

24. The collecting tank as claimed in claim 1, further comprising at least one connecting piece fluidly connected to the collecting tank, wherein the at least one connecting piece is configured to be fluidly connected to the tubes of the tube block, wherein a longitudinal axis of the at least one tie rod is substantially parallel to a longitudinal axis of the at least one connecting piece.

25. The collecting tank as claimed in claim 1, wherein the at least one tie rod is configured such that when the collecting tank is connected to the tube block the hollow space of the at least one tie rod is not fluidly connected to the tubes of the tube block.

26. The collecting tank as claimed in claim 1, wherein the tie rod extends through an interior of the collecting tank.

* * * * *

UNITED STATES PATENT AND TRADEMARK OFFICE

CERTIFICATE OF CORRECTION

PATENT NO. : 7,971,635 B2
APPLICATION NO. : 10/552722
DATED : July 5, 2011
INVENTOR(S) : Georg Kämmler It is certified that error appears in the above-identified patent and that said Letters Patent is hereby corrected as shown below:

On the Title Page

Item (75) Inventor "George Kämmler" should read --Georg Kämmler--

Item (22) PCT Filed "April 6, 2005" should read --April 6, 2004--

Signed and Sealed this
Eighteenth Day of March, 2014

Michelle K. Lee

Michelle K. Lee
*Deputy Director of the United States Patent and Trademark Office*